US010801467B2

(12) United States Patent
Lindholdt et al.

(10) Patent No.: US 10,801,467 B2
(45) Date of Patent: Oct. 13, 2020

(54) METHOD FOR CONTROLLING TORQUE EQUILIBRIUM OF A HYDRAULIC MOTOR

(71) Applicant: DIINEF AS, Kristiansand (NO)

(72) Inventors: Per Nielsen Lindholdt, Århus (DK); Geir-Kjetil Nerland, Hustad (NO); Henrik Bollerup Larsen, Stabekk (NO)

(73) Assignee: DIINEF AS, Kristiansand (NO)

( * ) Notice: Subject to any disclaimer, the term of this patent is extended or adjusted under 35 U.S.C. 154(b) by 0 days.

(21) Appl. No.: 16/347,468

(22) PCT Filed: Nov. 2, 2017

(86) PCT No.: PCT/NO2017/050283
§ 371 (c)(1),
(2) Date: May 3, 2019

(87) PCT Pub. No.: WO2018/084718
PCT Pub. Date: May 11, 2018

(65) Prior Publication Data

US 2019/0277245 A1 Sep. 12, 2019

(30) Foreign Application Priority Data

Nov. 4, 2016 (NO) ..... 20161750

(51) Int. Cl.
*F03C 1/34* (2006.01)
*F03C 1/40* (2006.01)
(Continued)

(52) U.S. Cl.
CPC ..... *F03C 1/0435* (2013.01); *F03C 1/0447* (2013.01); *F04B 7/0076* (2013.01); *F04B 49/03* (2013.01); *F04B 49/065* (2013.01)

(58) Field of Classification Search
CPC .... F03C 1/0435; F03C 1/0447; F04B 7/0076; F04B 49/065; F04B 49/03
See application file for complete search history.

(56) References Cited

U.S. PATENT DOCUMENTS 4,426,911 A 1/1984 Robinson et al.
4,785,714 A 11/1988 Tamada et al.
(Continued)

FOREIGN PATENT DOCUMENTS

GB 2477997 A 8/2011
WO WO 90/03519 A1 4/1990
WO WO 2015/112025 A1 7/2015

OTHER PUBLICATIONS

International Search Report and Written Opinion dated Feb. 14, 2018 issued in International Application No. PCT/NO2017/050283.
(Continued)

*Primary Examiner* — Zelalem Eshete
(74) *Attorney, Agent, or Firm* — Birch, Stewart, Kolasch & Birch, LLP

(57) ABSTRACT

A method for controlling torque equilibrium of a hydraulic motor, the method includes:

setting a torque equilibrium reference position in a control system, setting a reference direction in the control system, determining one or more high-pressure torque producing cylinders towards the torque equilibrium reference position in a reference direction in the control system, and opening a high-pressure valve on each of one or more high-pressure torque producing cylinders to produce a torque towards the torque equilibrium reference position in the reference direction on the drive shaft of the motor.

13 Claims, 5 Drawing Sheets

(51) Int. Cl.

| | |
|---|---|
| ***F04B 7/00*** | (2006.01) |
| ***F04B 49/03*** | (2006.01) |
| ***F04B 49/06*** | (2006.01) |

(56) References Cited

U.S. PATENT DOCUMENTS

| | | | |
|---|---|---|---|
| 2003/0110935 | A1 | 6/2003 | Nippert |
| 2011/0031422 | A1 | 2/2011 | Lopez Pamplona et al. |
| 2015/0211513 | A1 | 7/2015 | Rampen et al. |

OTHER PUBLICATIONS

Norwegian Office Action dated May 30, 2017 issued in Norwegian Patent Application No. 20161750.

METHOD FOR CONTROLLING TORQUE EQUILIBRIUM OF A HYDRAULIC MOTOR

CROSS-REFERENCE TO RELATED APPLICATIONS

This application is a 35 U.S.C. § 371 National Phase of PCT Application No. PCT/NO2017/050283 filed Nov. 2, 2017, which claims priority to Norwegian Application No. NO 20161750 filed Nov. 4, 2016. The disclosures of these applications are incorporated in their entireties herein by reference.

FIELD

The current invention is within the field of hydraulic machines. More specifically it is related to position and low speed control of hydraulic actuators and motors by forced digital valve control.

BACKGROUND

Hydraulic machines, such as hydraulic motors and hydraulic pumps are frequently used in industrial applications. In principle, hydraulic motors and hydraulic pumps can be interchangeable because they perform the opposite function, i.e. converting hydraulic pressure and flow into mechanical torque and rotation, and converting mechanical torque to hydraulic pressure, respectively. However, this is not always the case, as will be explained below.

Hydraulic pumps and motors are often combined into hydraulic drive systems or hydraulic transmissions that have a large number of possible applications, such as transmission systems for entrepreneurial machines, farming equipment, mining equipment, conveyers, wind turbines, etc.

By varying the displacement on the pump, motor or on both, the torque and rotational speed of the motor may be varied to provide a drive train with a variable gearing.

The majority of hydraulic pumps and motors have mechanical valve systems with rotating and stationary openings passing each other and together forming the connections between supply and displacement chambers. Some of the available disclosures within the field describe hydraulic machines with poppet valves with balanced actuation, i.e. where the pressure difference over the valve is used to open or close the valve. A return spring may be used for returning the valve to its initial closed or open position.

Increased efficiency and controllability for high speed pumps and motors has been achieved by replacing passive valves with electrically actuated valves, such as solenoids acting on a magnetic part of the valve.

The solenoids can then keep the valves in the open position once the open position has been reached, instead of letting the valves return passively to their initial position when the opening pressure difference across the valve decreases.

Solenoids are well known for keeping valves open. The solenoids are weak compared to the pressures over closed valves, but strong enough to keep a valve open against the flow in case they are already open. Such solenoid activated valves may be used to improve the efficiency of the hydraulic machine by using an external control system to control the activation of the solenoids and thereby the activation or deactivation of the corresponding cylinders.

A principal sketch of a balanced valve with solenoids for retaining a valve in open position is shown in FIG. 1. One cylinder with a cylinder chamber (4) and a piston (3) is shown. The valve (H) on the left-hand side is connected to a high-pressure source and the valve (L) to the left is connected to a high-pressure line. The forces (FL, FH) that can act on the valves when the solenoids (s) are activated are indicated as arrows.

International patent publication WO9003519 A1 discloses a method for displacement control of a multi-piston fluid pump by control of electrically selectable poppet valves on each of the cylinders. The poppet valves are equipped with an annular permanent magnet to latch to a solenoid.

However, while the prior art technology may work for a certain number of applications, such as for a hydraulic transmission system for e.g. power production or as part of a drivetrain of a vehicle, it will not work well for a hydraulic machine in an application where slow speed and fine grained control of speed and or toque and or direction and or position are required, e.g. high torque, low speed applications, or high speed applications where start and stop under load are required.

One example of such an application is a hydraulic winch where the winch must be operated in small steps, e.g. 20 degrees in one direction, 10 degrees backwards etc.

Another problem related to the prior art hydraulic machines is that they are mostly designed to rotate continuously, and therefore cannot easily be locked in a fixed position and released again under load. Again, consider a winch with a large load on the winching wire where the load reaches a desired position. In this position, it is necessary to stop the winch and lock it in the position for a certain while before it is started again.

International publication WO2015112025 A1, discloses a hydraulic machine valve arrangement with pilot valves to enable forced activation of the valves that enables start and stop of a motor under load and fine grained position control and low speed control. Further, it describes various schemes of displacement control.

US 2011031422 A1 shows a valve-controlled hydrostatic positive-displacement machine and a method for its control, the positive-displacement machine having a plurality of cylinder-piston units which are activated or deactivated via electrically or electro-hydraulically actuated low-pressure valves and via high-pressure valves for setting a delivery or absorption volume flow of the positive-displacement machine.

In GB 2477997 A proposes to minimise uneven, differential wear or resonance and encourage shaft balancing. The fluid volume displaced by any one cylinder may be set taking into account the suitability of that cylinder to deliver fluid based on historical or predicted cylinder usage data.

In US 2003110935 A1 selected ones of a plurality of pistons are held at their top dead center positions when delivery therefrom is not needed.

In US 20150211513 A1 a fluid-working machine has a working chamber of cyclically varying volume, high and low pressure manifolds, and high and low pressure valves for regulating the flow of fluid between the working chamber and the high and low pressure manifolds respectively. A controller actively controls at least one said valve to determine the net displacement of working fluid of the working chamber on a cycle by cycle basis.

SUMMARY

A main object of the present invention is to disclose a method for precise control of position and low speed of hydraulic machines. The method is based on establishing a torque equilibrium at a given point of a cycle of the hydraulic motor.

The present invention makes it possible to move the torque equilibrium to a different cycle, or point of a cycle of the motor, corresponding to a different shaft position. A stepwise change and fine positioning of the shaft is also possible, where the length of the steps can be controlled by changing the characteristics of the control pulses, e.g. the timing for opening and closing the valves, from the control system. These features are of specific importance for e.g. low speed motors driving demanding machinery such as winches.

A potential torque producing cylinder, as used in this document means a cylinder that, when activated with high or low-pressure, adds, or produces torque to the motor shaft (20) in a desired direction. The torque depends on motor geometry, current shaft position (a) and current cylinder pressure.

Inside the hydraulic motor, each cylinder will contribute with an individual cylinder torque. The sum of the individual cylinder torques make up the total torque, or simply torque, on the common shaft (20). The individual torques may contribute in opposite directions. Thus, for the purpose of the invention, both increasing an individual torque in the desired direction and decreasing an individual torque in the opposite direction will increase the total torque on the shaft (20). The method of the invention controls the torque contribution from the individual cylinders and thereby the torque equilibrium of the hydraulic motor (1). More specifically, the method according to the invention controls transitions between states or positions of torque equilibrium. Thus, a high-pressure torque producing cylinder is a cylinder that will produce torque that contributes to the total torque in the desired direction if its cylinder chamber is set under high-pressure, while a low-pressure torque producing cylinder is a cylinder that will produce torque that contributes to the total torque in the desired direction if its cylinder chamber is set under low-pressure, The advantages are obtained with the method according to the invention, for controlling torque equilibrium of a hydraulic motor (1), wherein the hydraulic motor (1) comprises; —two or more cylinders (10-1, 10-2, . . . ) with respective pistons (11-1, 11-2, . . . ), —a common shaft (20) driven by the pistons (11-1, 11-2, . . . ), —high and low-pressure valves (10-1H, 10-2H, . . . , 10-1L, 10-2L, . . . ) for each the two or more cylinders (10-1, 10-2, . . . ), —a control system (100) arranged to control opening and closing of the high and low-pressure valves (10-1H, 10-2H, . . . , 10-1L, 10-2L, . . . ).

The method comprises the following steps; —setting a torque equilibrium reference position (r) in the control system (100), —setting a reference direction (d) in the control system (100), —determining one or more high-pressure torque producing cylinders (10-1, 10-2, . . . ) towards the torque equilibrium reference position (r) in the reference direction (d) in the control system (100), —opening a high-pressure valve (10-1H, 10-2H, . . . ) on each of the one or more high-pressure torque producing cylinders (10-1, 10-2, . . . ) to produce a torque towards the torque equilibrium reference position (r) in the reference direction (d) on the common shaft (20).

In an advantageous embodiment, the hydraulic motor can be controlled to advance in small steps by taking advantage of the compressibility of the fluid in the hydraulic motor by; —determining one or more low-pressure torque producing cylinders (10-1, 10-2, . . . ) towards the torque equilibrium reference position (r) in the reference direction (d) in the control system (100), wherein the low-pressure torque producing cylinders (10-1, 10-2, . . . ) are compressed by a force from the common shaft (20), —opening a low-pressure valve (10-1L, 10-2L, . . . ) on each of the one or more low-pressure torque producing cylinders (10-1, 10-2, . . . ) to produce a torque towards the torque equilibrium reference position (r) in the reference direction (d) on the common shaft (20)

An advantage of this method is that it can be used to keep a loaded winch within a pre-defined position tolerance. All hydraulic machines have a certain leakage during operation, and by applying this method, the winch can automatically advance one or more small steps when the pre-defined tolerance limit is reached.

Further, the speed of the hydraulic motor, e.g. a winch can be controlled simply by changing the timing and frequency of the control scheme or by adding or removing cylinders that produce torque from the control Scheme.

BRIEF DESCRIPTION OF THE DRAWINGS

The attached figures illustrate some embodiments of the claimed invention.

DETAILED DESCRIPTION

The embodiments of the invention will be explained with reference to the accompanying drawings in FIG. 1 to FIG. 5.

The term "hydraulic motor geometry" as used in this document is meant to comprise main physical parameters of the hydraulic motor, such as;

Type of hydraulic motor,
Number of cylinders,
Cylinder volume,
Stroke length,
Relation between cylinder volume and shaft angle
Etc.

Based on these parameters, a control algorithm tailored for the specific hydraulic motor can be developed to allow the torque equilibrium control of the hydraulic motor.

Figure 1:
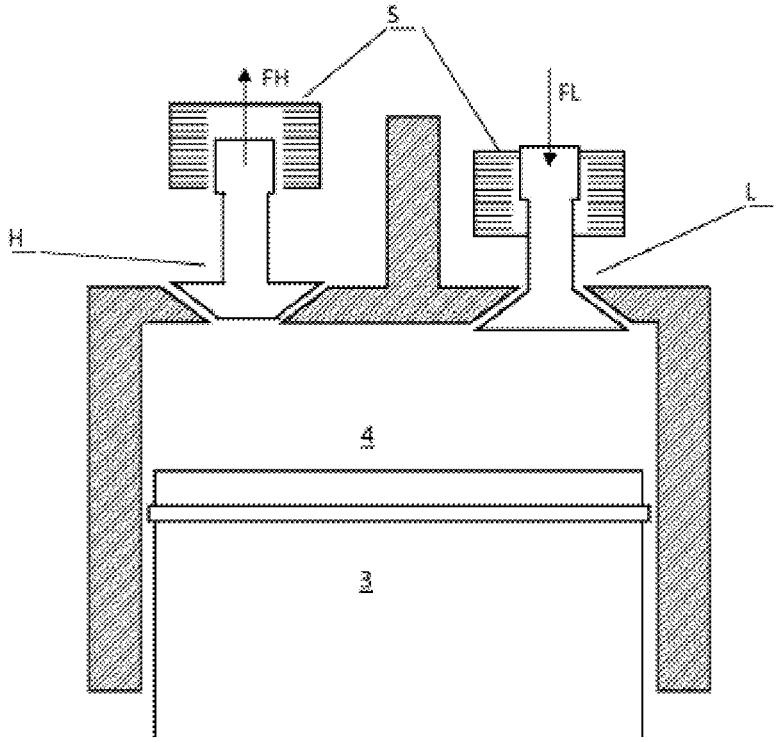
Fig. 1 (prior art)
FIG. 1 illustrates a principal sketch of a balanced valve with solenoids for retaining a valve in open position according to prior art.
Figure 2A:
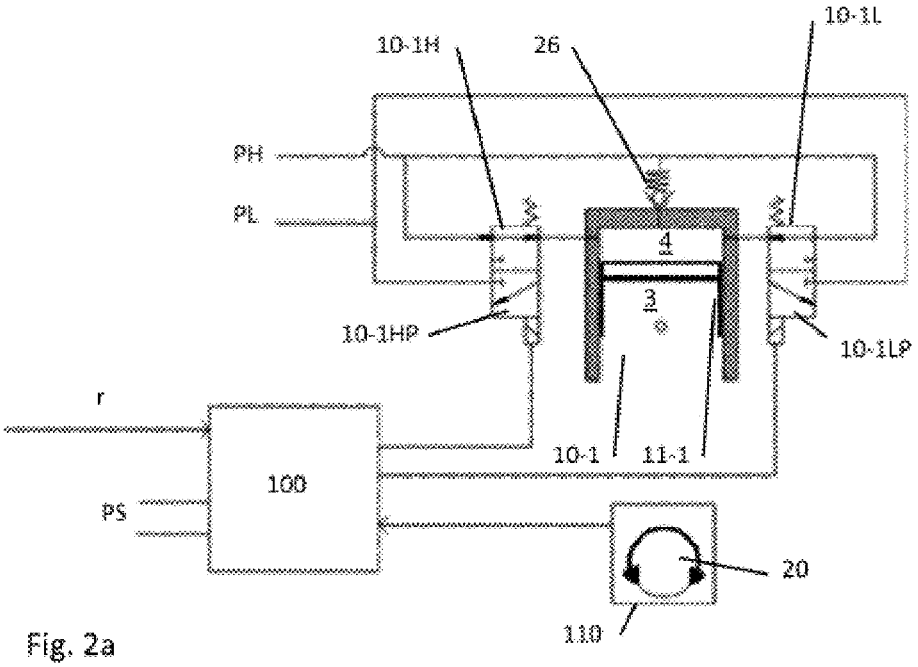
FIG. 2*a* illustrates schematically the main components of a hydraulic motor that can be used for performing the claimed invention.

FIG. 2*a* illustrates schematically the main components of a hydraulic motor (1) that can be used for performing the claimed invention. The motor comprises a number of cylinders (10-1, 10-2, . . . ). In this figure, only one cylinder (10-1) with corresponding cylinder, valves and piston is shown. However, the other cylinders of the hydraulic motor would have similar characteristics, as understood by a person skilled in the art.

In an embodiment, the hydraulic motor (1) comprises;

two or more cylinders (10-1, 10-11-2, . . . ) with respective pistons (11-1, 11-2, . . . ), a common shaft (20) driven by the pistons (11-1, 11-2, . . . ), high and low-pressure valves (10-1H, 10-2H, . . . , 10-1L, 10-2L, . . . ) for each the two or more cylinders (10-1, 10-2, . . . ).

The high and low-pressure valves (10-1H, 10-2H, . . . , 10-1L, 10-2L, . . . ) are connected to respective high and low-pressure sources (PH, PL). The pressure difference may be obtained by a hydraulic pump (not shown).

Further, the hydraulic motor comprises a main pilot valve (10-1HP, 10-2HP, . . . , 10-1LP, 10-2LP, . . . ) for each of the high and low-pressure valves (10-1H, 10-2H, . . . , 10-1L, 10-2L, . . . ), wherein the pilot valves (10-1HP, 10-2HP, . . . , 10-1LP, 10-2LP, . . . ) are controlled by a control system (100).

The pilot valves (10-1HP, 10-2HP, . . . , 10-1LP, 10-2LP, . . . ) are arranged to provide sufficient force on the high and low-pressure valves (10-1H, 10-2H, . . . , 10-1L, 10-2L, . . . ) to allow full activation of the high and low-pressure valves (10-1H, 10-2H, . . . , 10-1L, 10-2L, . . . ) at any time, independent of the current pressure inside the respective cylinder.

The control system (100) and solenoids operating the pilot valves may be powered by a Power Supply (PS).

Figure 2B:
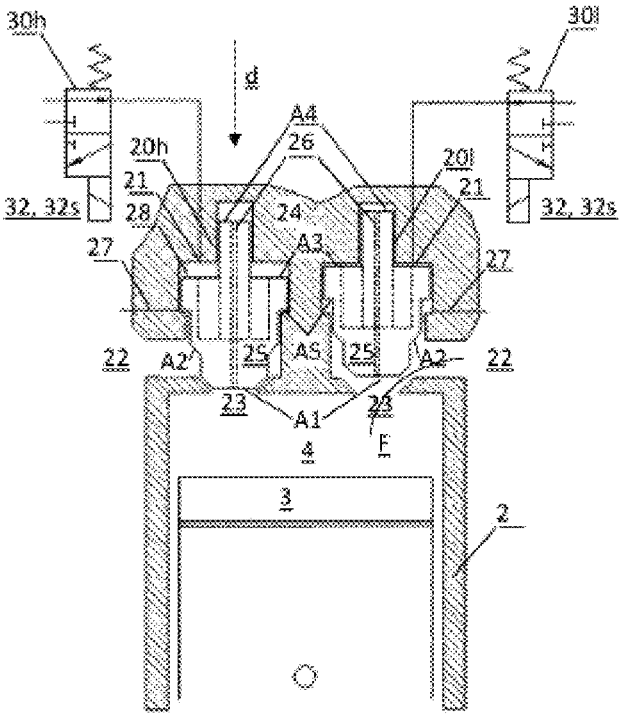
In FIG. 2*b* a valve arrangement that can be used for the purpose of the invention is further described.

In FIG. 2*b*, a valve arrangement that can be used for the purpose of the invention is further described. A cylinder (2) with a piston (3) and a cylinder chamber (4) of a hydraulic motor is shown. Although only one cylinder is shown here, the same valve arrangement may be used for the other cylinders of the hydraulic motor or for a hydraulic pump.

First and second pressure valves (20*h*, 201) of poppet types are in connection with a motor cylinder (2), where the main ports (22) of the first and second pressure valves (20*h*, 201) are connected to respective high- and low-pressure sides (Ph, PI) of a hydraulic pump (not shown).

Two pilot operated main valves (20*h*, 201) of poppet type connect each motor cylinder (2) with fluid supply lines, e.g. high- and low-pressure sides (Ph, PI).

The two main valves (20*h*, 201) are of similar configuration, with the cylinder chamber (4) connected to the working chamber port (23) of each main valve and one fluid supply line connected to the main port (22) of one valve (22*h*) and the other fluid supply line connected to the main port (22) of the other valve (221).

A valve (201, 20*h*) is the to be closed when there is no connection between the working chamber port (23) and the respective fluid connection.

Pilot means (30*h*, 301) operate the opening and closing of the valves (20*h*, 201) by controlling the pilot pressures in the pilot chambers of the valves (20*h*, 201) through the pilot port (21) of the valves (20*h*, 201), with the pressure working upon areas of third surface (A3) shown in FIG. 2*b*.

Although a cylinder type working chamber is shown in this embodiment, the method according to the invention and as described in the different embodiments may be used in combination with different types of hydraulic pumps and motors, e.g. cylinder and piston based, vane based etc.

Further, different types of valve configurations may be used in combination with the method, such as e.g. solenoid valves.

Figure 3:
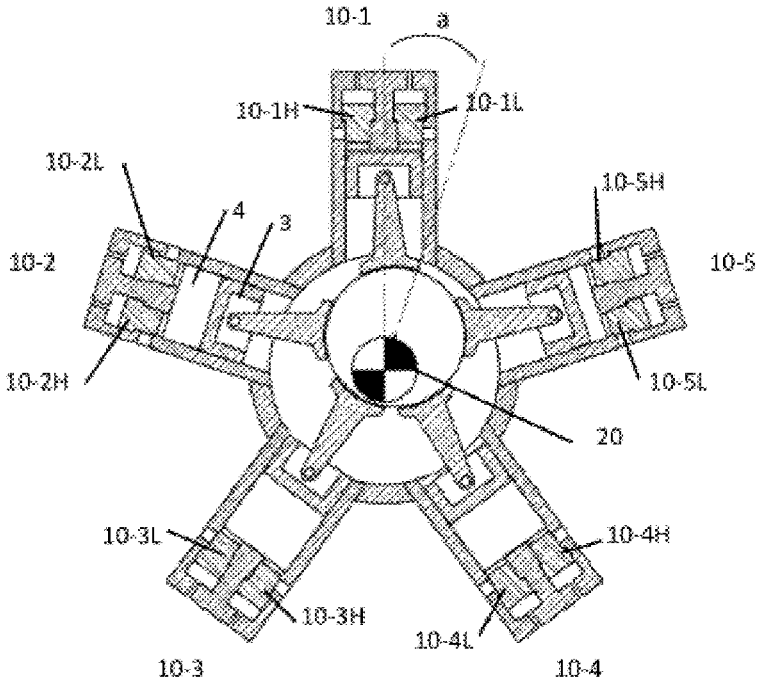
FIG. 3 illustrates an example of a hydraulic motor that can be used in an embodiment of the invention.

An example of a five-cylinder hydraulic motor (1) that can be used in an embodiment of the invention is illustrated in FIG. 3. Each of the cylinders (10-1, 10-2, . . . ) would have a similar valve arrangement as seen in FIG. 2, operated by the control system (100).

In an embodiment, the method comprises setting a torque equilibrium reference position (r) and a reference direction (d) in the control system (100).

Based on these values, the control system (100) determines one or more high-pressure torque producing cylinders (10-1, 10-2, . . . ), where torque is in the direction towards the torque equilibrium reference position (r) and in the reference direction (d). There will always be some cylinders that will produce torque if pressurized by opening a high-pressure port. The number depends e.g. on the number of cylinders and their angular distribution. In this step one or more of these potentially high-pressure torque producing cylinders (10-1, 10-2, . . . ) are selected.

Then, a high-pressure valve (10-1H, 10-2H, . . . ) on each of the one or more high-pressure torque producing cylinders (10-1, 10-2, . . . ) to produce a torque towards the torque equilibrium reference position (r) in the reference direction (d) on the common shaft (20) is opened by the control system (100).

In a motor with a shaft, the reference direction (d) can be forwards or backwards.

When one step has been taken, a next step can be taken by setting a new reference position and activating a new valve.

In an embodiment the invention then comprises the steps of sequentially; —setting an updated torque equilibrium reference position (r), —closing the high-pressure valve (10-1H, 10-2H, . . . ) on one or more of the one or more high-pressure torque producing cylinders (10-1, 10-2, . . . ), —repeating the steps above to produce a torque towards the updated torque equilibrium reference position (r) in the reference direction (d) on the common shaft (20).

The embodiments above are common for all embodiments described below.

For fine positioning the common shaft (20), a method where the motor torque equilibrium is manipulated by compressing and decompressing cylinder volumes is disclosed according to an embodiment of the invention. Opening one cylinder to high or low-pressure in this state gives a small change in the torque equilibrium of the common shaft (20), and the size of the change depends upon the actual torque contribution of the cylinder (10-1, 10-2, . . . ) where the pressure is being controlled and the compressibility of the fluid and the number of other cylinders on the motor and location of these other cylinders.

In an embodiment, that can be combined with any of the common embodiments above, the method comprises the steps of determining in the control system (100) one or more low-pressure torque producing cylinders (10-1, 10-2, . . . ) towards the torque equilibrium reference position (r) in the reference direction (d) in the control system (100), wherein the low-pressure torque producing cylinders (10-1, 10-2, . . . ) are compressed by a force from the common shaft (20). Then, opening a low-pressure valve (10-1L, 10-2L, . . . ) on each of the one or more low-pressure torque producing cylinders (10-1, 10-2, . . . ) to produce a torque towards the torque equilibrium reference position (r) in the reference direction (d) on the common shaft (20).

In a related embodiment, the method comprises the steps of initially determining which subset of cylinders (10-1, 10-2, . . . ) to include in a control scheme and closing all high and low-pressure valves (10-1H, 10-2H, . . . , 10-1L, 10-2L, . . . ) of cylinders (10-1, 10-2, . . . ) in the subset, and further opening all other low-pressure ports (10-1L, 10-2L, . . . ) and closing all other high-pressure ports (10-1H, 10-2H, . . . ).

In an embodiment, the subset can be determined dynamically during operation depending on the required torque.

In an alternative embodiment the method comprises the step of initially closing all high and low-pressure valves (10-1H, 10-2H, . . . , 10-1L, 10-2L, . . . ) before starting stepwise control.

Figure 4:
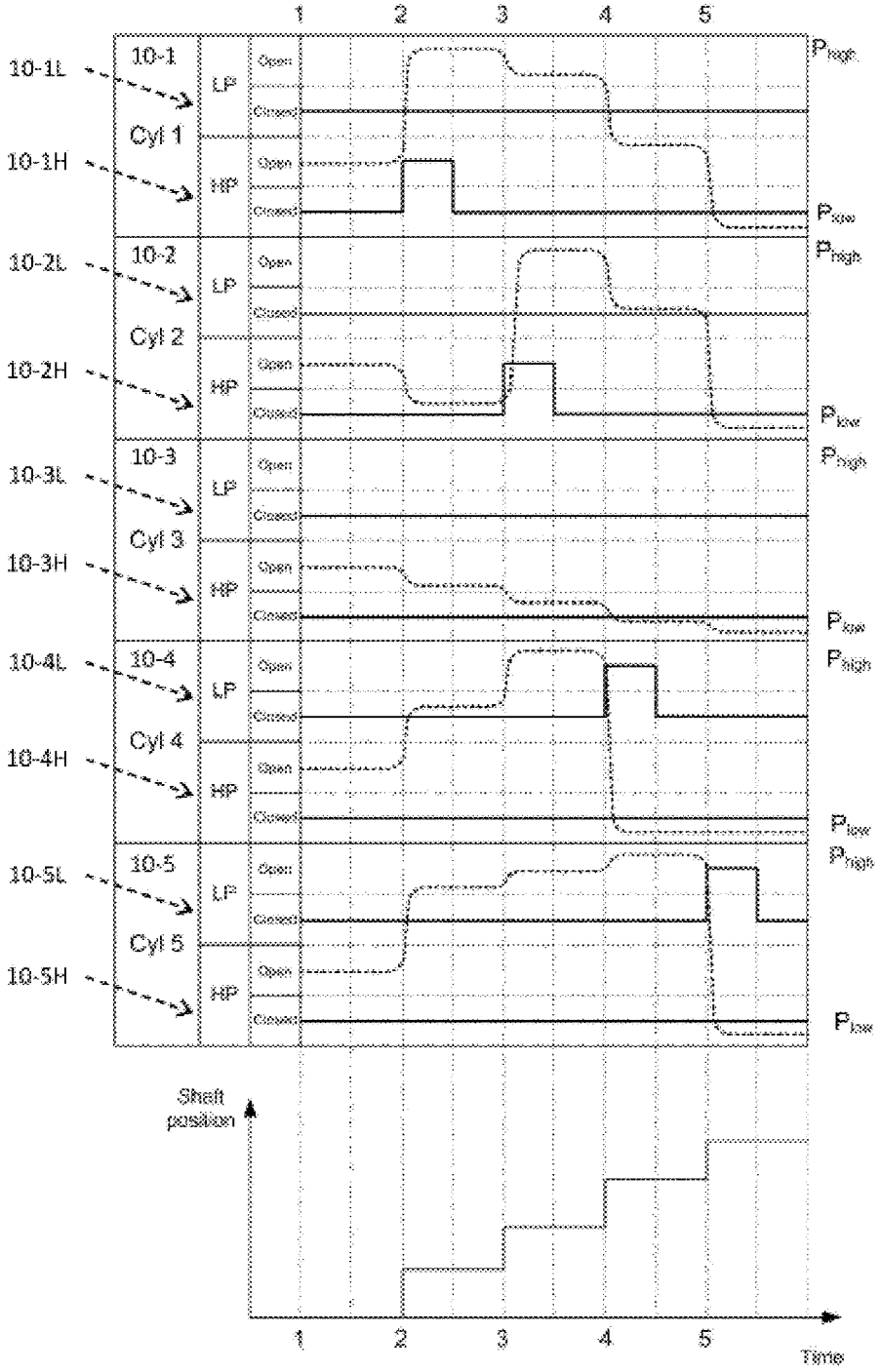
FIG. 4 illustrates in an embodiment of the invention how stepwise rotation based on torque equilibrium of the hydraulic motor of FIG. 3 can be achieved.

An example of how a hydraulic motor (1) is controlled to achieve the desired accuracy and precision according to the invention is illustrated in FIG. 4. This example is based on a 5 cylinder eccentric shaft radial piston motor as illustrated in FIG. 3, but it is also applicable to other types of cylinder numbers and motor types.

FIG. 4 illustrates in a diagram the positions of all the high and low-pressure valves (10-1H, 10-2H, . . . , 10-5H, 10-1L, 10-2L, . . . , 10-5L) of the 5 cylinders (10-1, 10-2, 10-3, 10-4, 10-5) as well as pressure variations in each of the cylinders as a result of valve operations. The diagram illustrates transitions between five sequential valve states, indicated by vertical lines and corresponding numbers above and below diagram. In addition, the stapled lines indicate the pressure variations for each of the cylinders. Below the valve and pressure diagram, the shaft position is illustrated for the different valve states, where each step represents a small rotation in the clockwise direction.

In state 1, all high and low-pressure valves (10-1H, 10-2H, . . . , 10-5H, 10-1L, 10-2L, . . . , 10-5L) are closed, and the cylinders are in the positions indicated in FIG. 3. I.e. cylinder 1 (10-1) is in upper position (Top Dead Centre), cylinder 2 (10-2) is in a middle position, cylinder 3 (10-3) is almost in lowest position (Bottom Dead Centre), cylinder 4 (10-4) is close to lowest position, and cylinder 5 (10-5) is above a middle position.

The purpose of the valve control operations next, is to move the hydraulic motor shaft clockwise and stepwise. Since the steps are small, e.g. 0.25 degree, no further illustrations corresponding to the section view in FIG. 3 are given for the next valve states.

The control system (100) controlling the valves is instructed, e.g. by an operator panel, that the operation is to be clockwise. In order to perform a clockwise operation, the control system (100) has to determine which cylinders are potential torque producing cylinders (10-1, 10-2, . . . ) in the clockwise direction. This depends on the current position of the pistons and the corresponding shaft position (a), as well as the hydraulic motor geometry, e.g., in this case 5 cylinders evenly distributed in a ring.

The control system will then determine that cylinders 1 and 2 (10-1, 10-2), as well as cylinder 3 (10-3) although only marginally, are all potential torque producing cylinders in the clockwise direction. This can also be observed in FIG. 4, since only these three cylinders will be able to rotate the shaft clockwise if high-pressure is imposed in the cylinders. The other cylinders would result in counter-clockwise operation. In this case, cylinder 1 (10-2) is selected.

In state 2, the high-pressure valve (10-1H) of cylinder 1 is opened. All other high and low-pressure valves remain closed.

This results in a pressure increase in cylinder 1 (10-1), which forces expansion of cylinder chamber 1 and a slight clockwise rotation of the shaft. This rotation further results in a change in all cylinder volumes of the other cylinders, since the fluid is compressible.

After a short time, pressure is stabilized in the cylinders, and a new equilibrium occurs. The hydraulic valve (10-1H) is then closed, and the equilibrium remains.

Next, in state 3, the high-pressure valve (10-2H) of cylinder 2 is opened. All other high and low-pressure valves remain closed.

This results in a pressure increase in cylinder 2 (10-2), which forces expansion of cylinder chamber 2 and a further slight clockwise rotation of the shaft. This rotation again further results in a change in all cylinder volumes of the other cylinders.

After a short time, pressure is stabilized in the cylinders, and a new equilibrium occurs. The hydraulic valve (10-2H) is then closed, and the equilibrium remains.

After two consecutive states with introduction of high-pressure into the first and second cylinders, the overall pressure in the system increases, and it seems difficult to continue this same approach to further displace the shaft clockwise.

In order to continue to perform a clockwise operation, the control system (100) now determines which cylinders are potential torque producing cylinder (10-1, 10-2, . . . ) in the clockwise direction if connected to low-pressure. This depends on the current position of the pistons and the corresponding shaft position (a), as well as the hydraulic motor geometry like before.

The control system will then determine that cylinders 4 and 5 (10-4, 10-5) are potential torque producing cylinders in the clockwise direction if connected to low-pressure. This can also be observed in FIG. 4, since only these two cylinders will be able to rotate the shaft clockwise if high-pressure is reduced in these cylinders. The other cylinders would result in counter-clockwise or no operation. In this case, cylinder 4 (10-4) is selected.

The low-pressure valve (10-4L) of cylinder 4 is opened. All other high and low-pressure valves remain closed.

This results in a pressure decrease in cylinder 4 (10-4), which forces compression of cylinder chamber 4 and a slight clockwise rotation of the shaft. This rotation further results in a change in all cylinder volumes of the other cylinders, since the fluid is compressible. Hydraulic fluid in opposite cylinders (10-1, 10-2, 10-3) is now de-compressed and fluid in cylinder 10-5 is further compressed.

After a short time, pressure is stabilized in the cylinders, and a new equilibrium occurs. The hydraulic valve (10-4L) is then closed, and the current equilibrium remains.

Next, in state 5, the low-pressure valve (10-5L) of cylinder 5 is opened. All other high and low-pressure valves remain closed.

This results in a pressure decrease in cylinder 5 (10-5), which forces compression of cylinder chamber 5 and a further slight clockwise rotation of the shaft. This rotation again further results in a change in all cylinder volumes of the other cylinders.

After a short time, pressure is stabilized in the cylinders, and a new equilibrium occurs. The hydraulic valve (10-5L) is then closed, and the equilibrium remains.

After state 5, it can be seen that the overall pressure in the cylinders remains low, and that further rotation only can be achieved by introducing high-pressure into a potential torque producing cylinder. In this case, the same cycle may be repeated.

According to the invention, torque equilibrium can be repeatedly established by operating valves in sequences by; sequentially one or more times; —opening and closing the high-pressure valve (10-1H, 10-2H, . . . ) on one or more of the one or more high-pressure torque producing cylinders (10-1, 10-2, . . . ), and sequentially one or more times; —opening and closing the low-pressure valve (10-1L, 10-2L, . . . ) on one or more of the one or more low-pressure torque producing cylinders (10-1, 10-2, . . . ).

Although not mentioned explicitly here, the valves may be operated in other sequences. However, this is considered within the scope of the invention as long as the sequences involve moving the common shaft (20) from a torque equilibrium position to another torque equilibrium position.

It should be noted that the stepwise rotation is possible due to the compressibility of the fluids in the cylinders. This means that even when both the high and low-pressure valves of a cylinder are closed, it is possible to move the piston. However, the further away from motor torque equilibrium, the larger the forces acting on the pistons are. When the pistons are driving a common shaft, these forces correspond to a torque, and one may say that transitions between valve states in torque equilibrium are obtained by taking advantage of the fluid compressibility.

If there are many cylinders, compression of one cylinder will give a small relative torque contribution and accordingly a small rotation of the common shaft (20). By compressing two or more cylinders simultaneously by opening the high-pressure valves simultaneously on two or more cylinders, a larger movement is obtained. The fluid in the cylinders working against, or resisting the movement, is compressed and is successively de-compressed when opening and closing the low-pressure valves. Each de-compression contributes to a movement in the intended direction. For larger movements, more cylinders can be decompressed simultaneously.

It is also possible to compress cylinders producing torque in the direction of the intended movement and simultaneously decompress cylinders producing torque against the intended movement and in this way increase speed.

If a cylinder producing torque against the movement is not decompressed while the other cylinders producing torque against the movement are decompressed, the pressure in the cylinder not being decompressed may exceed an acceptable maximum pressure. For safety reasons, a pressure relief function is needed. In an embodiment the hydraulic motor (1) comprises a pressure relief valve (26) for each of the cylinders (10-1, 10-2, . . . ).

Cylinders have different torque contributions depending on the state of each cylinder cycle, determined by the shaft position (a) and geometry of the hydraulic motor (1) and on cylinder pressure. As shaft position (a) and motor geometry are known, cylinders (10-1, 10-2, . . . ) can be chosen for compression or decompression depending on the desired shaft displacement.

If the motor is loaded with a large external torque in one direction and a movement against the external load is wanted, it is possible to limit the number of cylinders in operation, especially if many cylinders are available, the cylinders producing torque against the intended movement direction can all be connected to low-pressure and the cylinders producing torque in the intended movement direction can be pressurized one or more at a time. This can be performed successively if rotation is desired. This can be applied if the cylinders being pressurized one or more at a time are not able to produce torque enough to overcome the external load torque.

If the external load torque is smaller than torque from the cylinders being pressurized simultaneously, the movement will be decided by the motor geometry as explained below, rather than by torque equilibrium by compression and decompression.

If the motor is loaded with a large external torque load in the same direction as the intended movement, the cylinders producing torque in same direction as the intended movement are not needed, and only the cylinders producing torque in direction against the intended movement may be used. If one of these is decompressed by opening the low-pressure valve, the external load torque must be balanced by the other cylinders, and pressure in these other cylinders will increase and oil be compressed accordingly, and so the shaft will move. By successively decompressing cylinders, the movement can be controlled. To increase speed, more cylinders at a time can be decompressed. Also, speed can be increased if decompression is made more frequently.

If so many cylinders are decompressed, i.e. connected to low-pressure, simultaneously that the remaining cylinders under pressure cannot hold the torque, control is lost and the motor will keep rotating and the pressurized cylinders will send oil over the high-pressure relief valve (26) arrangement. Such a situation may be avoided by measuring the shaft load and pressure, and produce a sufficient combined total torque from cylinders with closed valves to hold the load torque or balance the load torque. However, in some situations it may also be used on purpose to increase speed and movement, if needed. To re-gain control, more cylinders can be closed.

Compression and decompression of some cylinders may be combined with other methods of controlling a motor, for instance displacement control. Some cylinders may perform displacement control, some may control position by equilibrium/compression-decompression. This can be an advantage as the displacement control is a more energy efficient way of operating a motor and as the torque ripples produced by the equilibrium method will be smaller as less cylinders are used.

In an embodiment that can be combined with any of the embodiments above, the displacement reference setting is continuously integrated over the shaft angle, and the result being the total geometric volume of oil that should have been moved.

Each time a new cylinder is up for choice of activation or de-activation, the volume error value is evaluated. If the value is above a specified threshold, the new cylinder is activated. If the value is below the threshold, the new cylinder is not activated but idled. Each time a cylinder is activated, this cylinders volume is subtracted from the integral of the reference setting. The result is the volume error.

In this embodiment, that can be combined with any of the embodiments above, the method therefore comprises integrating a displacement reference over a changing shaft position (a) of said common shaft (20) to obtain a reference geometric amount of moved fluid.

Further, calculating a volume error value being a difference between said reference geometric amount of moved fluid and successively subtracted effective volume of said cylinders (10-1, 10-2, . . . ) being activated, determine whether a next cylinder (10-1, 10-2, . . . ) is available for displacement control, —if said next cylinder (10-1, 10-2, . . . ) is available for displacement control; —activate said next cylinder (10-1, 10-2, . . . ) if said volume error value is above a threshold value, and idle said next cylinder (10-1, 10-2, . . . ) if said volume error value is below said threshold value.

Activating means to open the high-pressure valves (10-1H, 10-2H, . . . ) and closing the low pressure valves (10-1L, 10-2L, . . . ) of the activated cylinder, while idling means to close the high-pressure valves (10-1H, 10-2H, . . . ) and open the low pressure valves (10-1L, 10-2L, . . . ) on the idling cylinder.

In an embodiment that can be combined with any of the embodiments above, the method comprises repeatedly;

determining in said control system (100) an instant torque contribution value for a group of said cylinders (10-1, 10-2, . . . ), evaluate in said control system (100) possible combinations of instant torque contribution values for said group of said cylinders (10-1, 10-2, . . . ), choose in said control system (100) a combination of torque contribution values based on a selection criteria to obtain a desired combined torque contribution, and activate or de-activate each cylinder (10-1, 10-2) in said group based on the chosen combination of torque contribution values, by opening and closing respective high and low-pressure valves (10-1H, 10-2H, . . . , 10-1L, 10-2L, . . . ) on each of said cylinders (10-1, 10-2, . . . ) in said group to obtain said desired combined torque contribution. The overall torque of the motor will then become the combined contribution from the above method in addition to the torque from the cylinders controlled based on torque equilibrium.

A similar control scheme as the one illustrated in FIG. 4, can be used when the hydraulic motor is used for continuous rotation. However, the control system (100) will have to take into account that the high and low-pressure torque producing cylinders will depend on the current shaft position (a).

For many of the examples provided above, it will be advantageous to measure the position of the common shaft and use this as a feed-back to the control system (100). In an embodiment, the hydraulic motor (1) therefore comprises a shaft position sensor (110) indicated in FIG. 2*a*, connected to the control system (100). With a shaft position sensor (110) the method comprises in an embodiment the steps of: —sensing a current shaft position (a) from the shaft position sensor (110), —based on the torque equilibrium reference position (r) and the current shaft position (a), determining the one or more high-pressure torque producing cylinders (11-1, 11-2, . . . ) in the reference direction (d).

In the same way the current shaft position (a) can be used to determine the low-pressure torque producing cylinders (11-1, 11-2, . . . ) in the reference direction (d).

The control system (100) will use one or more of the hydraulic motor geometry parameters as described previously in the step of determining the high/low-pressure torque producing cylinders (11-1, 11-2, . . . ).

In an embodiment, the torque equilibrium at a specific position of the hydraulic motor is established by relying on the geometry of the hydraulic motor (1).

In this embodiment, the current shaft position (a) will always move towards the position of torque equilibrium defined by which cylinders are set to high-pressure and which cylinders are set to low-pressure. I.e. setting one cylinder to high-pressure and the rest to low-pressure rotates the shaft so the pressurized cylinder reaches its Bottom Dead Centre. With two cylinders set to high-pressure the equilibrium position is the position where both cylinders are equally close to their Bottom Dead Center. With an external torque load on the shaft, the position of equilibrium will move until the net torque is zero.

Figure 5:
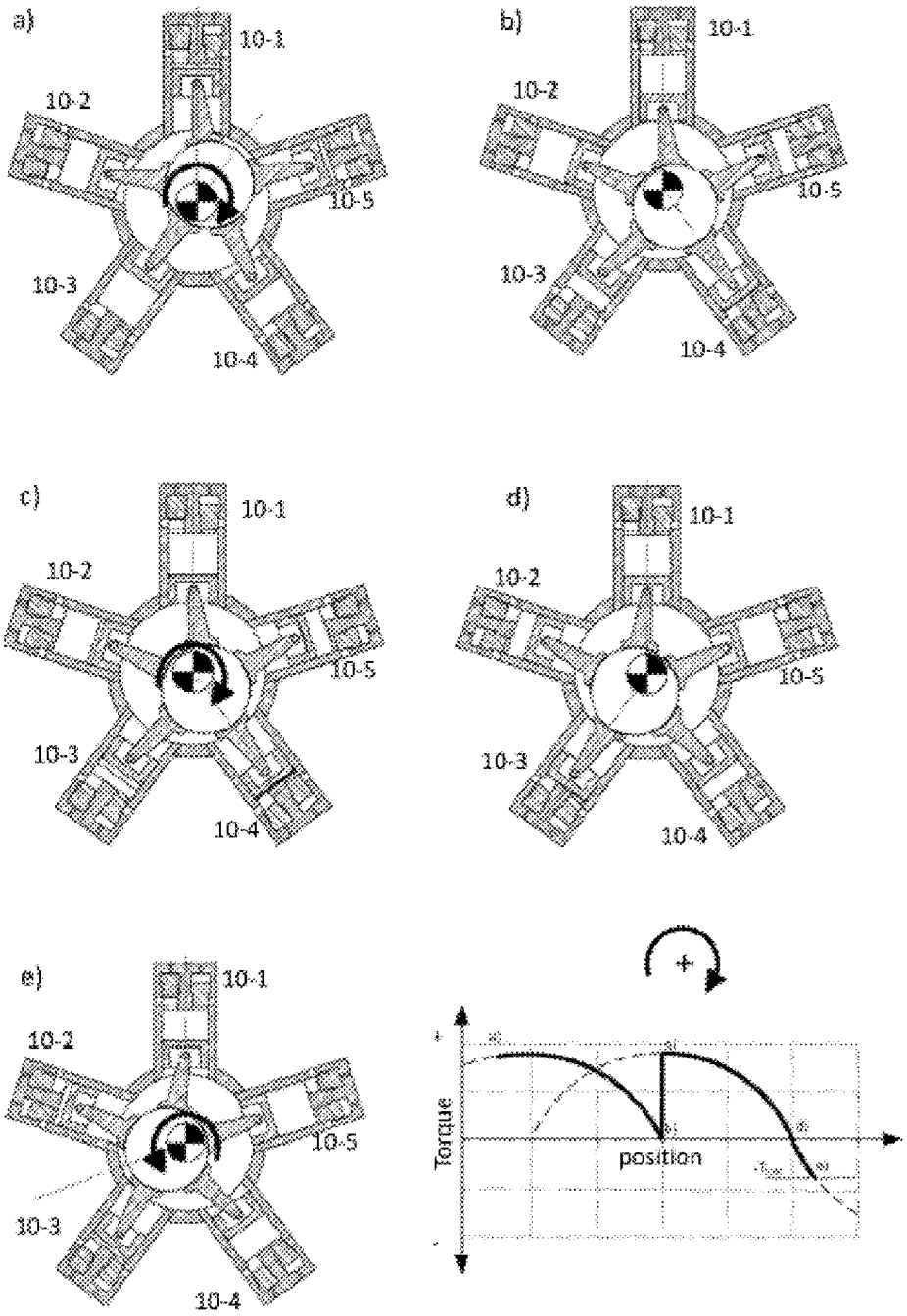
FIG. 5 illustrates an embodiment of the invention where the torque equilibrium at a specific position of the hydraulic motor is established by relying on the geometry of the hydraulic motor.

FIG. 5 shows an example of different states of a hydraulic motor (1) with five cylinders, similar to the motor described above, but it is also applicable to other cylinder numbers and motor types including cam lobe motors and other positive displacement machines.

During the five states the hydraulic motor rotates from position a) to obtain a torque equilibrium in position b), Then, by means of controlling the high and low-pressure valves, the hydraulic motor is forced to the new equilibrium position d). Further, position e) indicates the torque response of the hydraulic motor when an external force is trying to bring the hydraulic motor out of torque equilibrium. The diagram to the lower right illustrates the torque of the motor in the mentioned positions.

Below is a more detailed description of the indicated scenario.

In position a) the high-pressure valves (10-1H, 10-2H) for cylinders 1 and 2 (10-1, 10-2) are open. The other high-pressure valves are closed, while low-pressure valves (, 10-3L, 10-4L, 10-5L) are open. There is no torque load on the shaft. The motor will produce torque in the clockwise direction until it has rotated to equilibrium position b).

In position b) the equilibrium will be maintained as long as the pressure remains high in cylinders 1 and 2 and low in cylinders 3, 4 and 5.

In position c) the high-pressure valve (10-2H) is closed, and low-pressure valve (10-2L) is opened. Further high-pressure valve (10-5H) is opened, and low-pressure valve (10-5L) is closed. Thus, instead of high-pressure in cylinders 1 and 2 (10-1, 10-2) in positions a) and b), there is now high-pressure in cylinders 1 and 5 (10-1, 10-5).

This results in a high torque on the motor shaft (20) as illustrated in the diagram, and the motor shaft (20) will rotate to a new equilibrium in position d), in this case 72 degree clockwise from position b).

In position d) the equilibrium will be maintained as long as the pressure remains high in cylinders 1 and 5 and low in cylinders 2, 3 and 4.

Position e) illustrates an example where an external load torque (Tload) on the motor shaft (20), in positive, clockwise direction will try to turn the shaft (20) of the hydraulic motor (1). As illustrated, the external torque load (Tload) manages to turn the shaft a small angle out of equilibrium position, but due to the motor geometry, the negative torque set up by the hydraulic motor (1) will increase with increased deviation from the torque equilibrium in position e), and the negative motor torque, illustrated as an arrow in position e), will balance the positive external load torque.

Control quality improves as the number of cylinders increases. In an embodiment, the actual torque can be monitored by the control system (100) by summing up the torque contributions from cylinders that are pressurized.

In a related embodiment, a more precise estimate is made by including the relatively small contributions from the cylinders connected to low-pressure. Even more precision may be obtained by including also friction values in the estimates. The torque estimate can be used to estimate the load characteristics by e.g. system identification methods well known from control theory.

When changing torque equilibrium direction by shifting the cylinders under pressure, the direction change is decided by the location of the cylinders being pressurized compared to the cylinders not being pressurized. When many cylinders are available, the change in torque equilibrium direction can be made small. E.g. in a 30 cylinder motor with equally distributed cylinders of equal size, cylinder 12-25 may be pressurized, and by shifting this to cylinder 13-26, the torque equilibrium position is changed 360°/30=12°.

The speed of the motor shaft towards a certain position depends on the magnitude of the net torque of the hydraulic motor (1). The magnitude of the torque can be altered by pressurizing more or less cylinders, i.e. opening high-pressure valves and closing low-pressure valves. E.g. the unloaded equilibrium direction with only cylinder 15 pressurized is the same as the unloaded equilibrium direction with cylinders 14, 15 and 16 pressurized. If shifting from cylinder 15 being pressurized to cylinders 15 and 16 being pressurized, the equilibrium position changes 6°, and at the same time the torque when the shaft is turned away from the motor equilibrium increase to approximately the double. Accordingly when changing number of cylinders, also the magnitude of torque will change, but all predictable. Different strategies may be applied as indicated above.

If the combined torque from the pressurized cylinders is not higher than the external load torque, there is a risk that the hydraulic motor will exceed a torque maximum point and seek another equilibrium point than the one intended. In an eccentric shaft radial piston motor or in a swash plate motor this equilibrium will be one revolution away. In a cam-lobe motor, there will be more equilibriums within one revolution, depending on the number of lobes on the cam ring. If the load toque is then still too high, the motor will still not stay in the equilibrium. Effectively, the result is loss of control.

In an embodiment, the torque equilibrium position is moved to follow a varying position (e.g. in a trajectory control system or simply in a speed control system) this may occur for instance if it is necessary to accelerate an inertia. In such case, shifting the torque equilibrium position should be done in such way that the load can follow the changing torque equilibrium positions without missing a motor revolution (loss of control).

One way to prevent this, is to continuously monitor the actual motor torque compared to the maximum motor torque.

In an embodiment, such a method comprises the steps of;

measuring the shaft position (a), —estimating a maximum shaft angle (am) of a maximum motor torque in the desired direction based on the identity of pressurized cylinders (10-1, 10-2, . . . ) and the shaft position (a), comparing the shaft position (a) with the maximum shaft angle (am).

In an alternative method, the torque is used instead of the angle;

measuring the shaft position (a), calculating an actual motor torque based on the shaft position (a), —estimating a maximum motor torque in the desired direction based on the identity of pressurized cylinders (10-1, 10-2, . . . ) and the shaft position (a), comparing the actual motor torque with the maximum motor torque.

In such way, it is possible to estimate a torque safety margin and an angle safety margin.

In an embodiment related to the embodiments above, the methods comprises the following steps;

establish a pre-defined torque or shaft angle upper limit that is below the maximum shaft angle (am) or the maximum motor torque, based on a safety margin, compare the shaft position (a) or motor torque with the pre-defined torque or shaft angle upper limit, pressurize additional cylinders if the shaft position (a) or motor torque is at the upper limit. de-pressurize one or more pressurized cylinders if the shaft position (a) or motor torque is below the upper limit.

When moving the torque equilibrium angle or position, or changing the magnitude of the motor torque, the controller can predict the safety margin of the new combination and the actual torque of the new combination and the angle of the new combination and the prediction can be used to select between the most desired combinations of cylinders.

In an embodiment, the method therefore comprises;

changing the magnitude of the motor torque, predict in the control system a new safety margin, The selection may be based on for instance but not limited to angle safety margin, torque safety margin, change in torque (i.e. torque "ripple"), change in equilibrium angle.

Normally, shifting torque equilibrium angle or magnitude implies shifting one or more cylinders from low-pressure to high-pressure in an expansion stroke and/or from high-pressure to low-pressure in a compression stroke. Neither is beneficial for efficiency in a digital motor. Accordingly, it is attractive to have few cylinders operating in this mode.

One way to minimize the number of cylinders operated according to the principle is to combine it with a displacement control or torque control that generates some of the torque necessary. That way fewer cylinders may be needed for torque equilibrium.

When combining the two methods it is possible to control the position/speed with the torque equilibrium method while the displacement control enables x % of the torque to be applied with less energy losses, since full stroke displacement control is the most energy efficient way to rotate the motor. Displacement can also be adjusted on the fly if the load situation changes and it is more energy efficient to change displacement than shifting cylinders between low and high-pressure.

When combining the two methods, it may appear that pressurizing one same cylinder may be needed by both methods. This must be avoided as a cylinder cannot give two torque contributions. One way to avoid this is to pressurize an additional cylinder close to the one that was initially selected. For instance, if a cylinder that should have been used for torque equilibrium is used for displacement control, the nearest available cylinder is used for torque equilibrium. This will give a small error that in many situations is acceptable.

The combination of methods works better the more cylinders are available, and cylinders may be located on one motor or distributed on more motors.

In an alternative embodiment for reducing the number of pressurized cylinders wherein said common shaft (20) follows a pre-determined path, or trajectory. The method comprises the following steps;

setting a pre-defined trajectory in the control system (100), then sequentially;

updating the torque equilibrium reference position (r) according to the trajectory, selecting in the control system (100) a group (g) of high-pressure torque producing cylinders (10-1, 10-2, . . . ) according to one of the methods above, updating in the control system (100) the selection of the high-pressure torque producing cylinders (10-1, 10-2, . . . ) in the group (g) based on the updated torque equilibrium reference position (r), selecting in the control system (100) a sub-group (sg) of the high-pressure torque producing cylinders (10-1, 10-2, . . . ) that due to rotation turns into low-pressure torque producing cylinders, based on the current shaft position (a) and the motor geometry, —opening a high-pressure valve (10-1H, 10-2H, . . . ) on each of the high-pressure torque producing cylinders (10-1, 10-2, . . . ) in the sub-group (sg), while closing the high-pressure valve (10-1H, 10-2H, . . . ) on the members of the group (g) that are not members of the sub group (sg).

In this way, no cylinders will work against the net-torque of the hydraulic motor (1), and losses are reduced and only a sufficient number of cylinders are producing torque.

As indicated previously, one way of successfully implementing the method according to the invention, is to use pilot operated valves.

In an embodiment, that can be combined with any of the embodiments above, the hydraulic motor (1) therefore comprises a main pilot valve (10-1HP, 10-2HP, . . . , 10-1LP, 10-2LP, . . . ) for each of the high and low-pressure valves (10-1H, 10-2H, . . . , 10-1L, 10-2L, . . . ), wherein the pilot valves (10-1HP, 10-2HP, . . . , 10-1LP, 10-2LP, . . . ) are controlled by the control system (100), and the step of opening and closing the high and low-pressure valves (10-1H, 10-2H, . . . , 10-1L, 10-2L, . . . ) comprises activating a respective main pilot valve (10-1HP, 10-2HP, . . . , 10-1LP, 10-2LP, . . . ).

In relation to the definition of total torque previously in the document, the method comprises in an embodiment, that can be combined with any of the embodiments above, the step of summarizing in the control system (100) torque from all cylinders (10-1, 10-2, . . . ) where the high-pressure valve (10-1H, 10-2H, . . . ) is open, to obtain a value for total torque produced by the hydraulic motor (1).

The method can be used to control two or more mechanically interconnected, motors (1) as if they were one motor. I.e. with common shafts (20), or drive shafts interconnected. Then the control system will be a common control system (100) connected to—, and arranged to control all valves (10-1H, 10-2H, . . . , 10-1L, 10-2L, . . . ) of all the hydraulic motors (1). Further, each of said one or more additional hydraulic motors (1) also comprises;

two or more cylinders (10-1, 10-2, . . . ) with respective pistons (11-1, 11-2, . . . ), a common shaft (20) driven by said pistons (11-1, 11-2, . . . ), high and low-pressure valves (10-1H, 10-2H, . . . , 10-1L, 10-2L, . . . ) for each said two or more cylinders (10-1, 10-2, . . . ), and said common shafts (20) of all said hydraulic motors (1) are mechanically interconnected.

The control system (100) is in this embodiment arranged to control opening and closing of said high and low-pressure valves (10-1H, 10-2H, . . . , 10-1L, 10-2L, . . . ) of all said hydraulic motors (1), and to control all said hydraulic motors (1) in the same way as controlling a single hydraulic motor (1) according to any of the embodiments above.

The invention claimed is:

1. A method for controlling torque equilibrium of a hydraulic motor comprising:

two or more cylinders with respective pistons;

a common shaft driven by the pistons;

high and low-pressure valves for each the two or more cylinders; and a control system arranged to control opening and closing of the high and low-pressure valves, wherein the method comprises the steps of:

setting a torque equilibrium reference position in the control system for the common shaft;

setting a reference direction for the common shaft in the control system;

determining one or more high-pressure torque producing cylinders towards the torque equilibrium reference position in the reference direction in the control system, wherein a high pressure torque producing cylinder is configured to produce a torque towards the torque equilibrium reference position in the reference direction when a cylinder chamber of the high pressure torque producing cylinder is set under high pressure; and opening the high-pressure valve on each of the one or more high-pressure torque producing cylinders to produce a torque towards the torque equilibrium reference position in the reference direction on the common shaft.

2. The method for controlling torque equilibrium according to claim 1, comprising steps of sequentially:

setting an updated torque equilibrium reference position;

closing the high-pressure valve on one or more of the one or more high-pressure torque producing cylinders; and repeating steps of:

setting a torque equilibrium reference position in the control system;

setting a reference direction in the control systems;

determining one or more high-pressure torque producing cylinders towards the torque equilibrium reference position in the reference direction in the control system; and opening the high-pressure valve on each of the one or more high-pressure torque producing cylinders to produce a torque towards the torque equilibrium reference position in the reference direction on the common shaft produce a torque towards the updated torque equilibrium reference position in the reference direction on the common shaft.

3. The method of controlling torque equilibrium of claim 1, further comprising:

determining one or more low-pressure torque producing cylinders towards the torque equilibrium reference position in the reference direction in the control system, where a low pressure torque producing cylinder is configured to produce a torque that contributes to the total torque in the reference direction when a cylinder chamber of the low pressure torque producing cylinder is set under low pressure, wherein the low-pressure torque producing cylinders are compressed by a force from the common shaft, opening a low-pressure valve on each of the one or more low-pressure torque producing cylinders to produce a torque towards the torque equilibrium reference position in the reference direction on the common shaft.

4. The method for controlling torque equilibrium according to claim 3, comprising a step of initially closing all high and low-pressure valves.

5. The method for controlling torque equilibrium according to claim 2, further comprising steps of sequentially one or more times:

opening and closing the high-pressure valve on one or more of the one or more high-pressure torque producing cylinders, and sequentially one or more times:

opening and closing the low-pressure valve on one or more of the one or more low-pressure torque producing cylinders.

6. The method of controlling torque equilibrium of claim 1, wherein the hydraulic motor comprises:

a shaft position sensor connected to the control system, and wherein the method comprises the steps of:

sensing a current shaft position from the shaft position sensor; and based on the torque equilibrium reference position and the current shaft position, determining the one or more high-pressure torque producing cylinders in the reference direction.

7. The method of controlling torque equilibrium of claim 1, wherein the determining the high-pressure torque producing cylinders, is based on one or more hydraulic motor geometry parameters.

8. The method of controlling torque equilibrium of claim 7, wherein the hydraulic motor geometry parameters comprise a total number of cylinders of the hydraulic motor.

9. The method of controlling torque equilibrium of claim 7, wherein the hydraulic motor geometry parameters comprise a motor type.

10. The method of controlling torque equilibrium of claim 1, wherein the hydraulic motor comprises a main pilot valve for each of the high and low-pressure valves, and wherein the respective main pilot valves are controlled by the control system, and the opening and closing of the high and low-pressure valves comprises activating a respective main pilot valve.

11. The method of controlling torque equilibrium of claim 1, further comprising the step of:

summarizing a control system torque from all cylinders where the high-pressure valve is open, to obtain a value for total torque produced by the hydraulic motor.

12. The method of controlling torque equilibrium of claim 1, comprising:

integrating a displacement reference over a changing shaft position of the common shaft to obtain a reference geometric amount of moved fluid;

calculating a volume error value as a difference between a reference geometric amount of moved fluid and successively subtracted effective volume of cylinders being activated;

determine whether a next cylinder is available for displacement control;

when the next cylinder is available for displacement control;

activate the next cylinder when the volume error value is above a threshold value, and idle the next cylinder when the volume error value is below the threshold value.

13. The method of controlling torque equilibrium of claim 1, comprising controlling torque equilibrium in one or more additional hydraulic motors, wherein each of the one or more additional hydraulic motors also comprises:

two or more cylinders with respective pistons;

a common shaft driven by the respective pistons; and high and low-pressure valves for each the two or more cylinders, wherein the common shafts of all the hydraulic motors are mechanically interconnected, and wherein the control system is arranged to control opening and closing of the high and low-pressure valves of all the hydraulic motors, and to control all the hydraulic motors in the same way as controlling a single hydraulic motor in claim 1.

* * * * *